United States Patent [19]

Fey et al.

[11] Patent Number: 4,582,004

[45] Date of Patent: Apr. 15, 1986

[54] ELECTRIC ARC HEATER PROCESS AND APPARATUS FOR THE DECOMPOSITION OF HAZARDOUS MATERIALS

[75] Inventors: Maurice G. Fey, Plum Boro; Joseph W. George, Blairsville; Thomas N. Meyer, Murrysville; William H. Reed, Monroeville; Raymond F. Taylor, Jr., Plum Boro, all of Pa.

[73] Assignee: Westinghouse Electric Corp., Pittsburgh, Pa.

[21] Appl. No.: 510,508

[22] Filed: Jul. 5, 1983

[51] Int. Cl.[4] ..... F23G 7/04; F23G 7/06; G21F 9/14

[52] U.S. Cl. ..... 110/346; 110/237; 110/250; 252/626; 252/632; 422/186.23

[58] Field of Search ..... 252/626, 630, 631, 632; 422/186.03, 186.04, 186.21, 905, 186.23, 186.05; 110/346, 237, 238, 250, 252, 253

[56] References Cited

U.S. PATENT DOCUMENTS

| | | | |
|---|---|---|---|
| 777,485 | 12/1904 | Pauling | 422/186.23 |
| 3,410,776 | 11/1968 | Bersin | 204/193 |
| 3,663,792 | 5/1972 | Fey | 219/121 P |
| 3,666,673 | 5/1972 | Knoll | 252/632 |
| 3,775,621 | 11/1973 | Gorin | 422/186.05 |
| 3,844,716 | 10/1974 | Noakes | 422/186.23 |
| 3,925,177 | 12/1975 | Kofoid | 422/186.21 |
| 4,008,171 | 2/1977 | Tiepel et al. | 252/632 |
| 4,040,973 | 8/1977 | Szivos et al. | 252/632 |
| 4,053,432 | 10/1977 | Tiepel et al. | 252/632 |
| 4,246,255 | 1/1981 | Grantham | 423/259 |
| 4,276,834 | 7/1981 | Bregulla et al. | 252/632 |
| 4,352,332 | 10/1982 | Baston | 252/626 |
| 4,431,612 | 2/1984 | Bell et al. | 422/186.21 |
| 4,437,999 | 3/1984 | Mayne | 252/626 |

FOREIGN PATENT DOCUMENTS

| | | | |
|---|---|---|---|
| 3013551 | 10/1980 | Fed. Rep. of Germany | 252/626 |

OTHER PUBLICATIONS

Baur, P., 1982, Process Destroys PCBs Leaving Other Insulating Fluids Intact, POWER, 126(8): 134.

*Primary Examiner*—Stephen J. Lechert, Jr.
*Assistant Examiner*—Howard J. Locker
*Attorney, Agent, or Firm*—John Victor Pezdek

[57] ABSTRACT

This invention relates to an electric arc heater process and apparatus for the essentially complete decomposition of hazardous materials including polychlorinated biphenyls. Finely divided liquid or gaseous hazardous material is injected into a primary gas stream which has been superheated in an electric arc heater. The mixture is directed into a primary reactor for complete decomposition with dwell times in the reactor being in the order of 0.05 to 0.15 seconds. The decomposition products are neutralized with the gases being released to atmosphere and any remaining particulates being collected for ultimate disposal. Large solid hazardous material is first shredded then heated in a roaster or rotary kiln to vaporize the primary gas stream. A soaking reactor is provided where increased dwell times are required for the decomposition of thermally stable compounds which may be formed in the primary reactor. When these compounds are absent the soaking reactor can be by-passed.

17 Claims, 4 Drawing Figures

ELECTRIC ARC HEATER PROCESS AND APPARATUS FOR THE DECOMPOSITION OF HAZARDOUS MATERIALS

BACKGROUND OF THE INVENTION

1. Field of the Invention

This invention relates to high temperature processes and apparatuses for the incineration or decomposition of hazardous materials.

2. Description of the Prior Art

Incineration at high temperatures is a common acceptable method for destruction of hazardous wastes or materials contaminated by hazardous wastes. Typically, temperatures of 2,000° F. to 3,000° F. are generally used, with dwell times in the incinerator being consistent with the degree of destruction required for the particular waste material being incinerated. In a conventional incineration process, fuel oil or natural gas is used along with the material being incinerated to achieve or maintain the minimum required temperature for decomposition.

With conventional incineration a temperature limitation problem arises. There the maximum temperature that the material being incinerated will be exposed to is limited by either the actual flame temperature of the material or the flame temperature of the fuel being used in the incinerator. Because of this maximum temperature limitation, the dwell time, the time the material must spend in the incinerator to reach the degree of destruction required, must be extended. Accordingly, the equipment required for these conventional incineration processes is generally large because of the dwell times required. This equipment is also expensive to purchase, install and maintain.

In U.S. Pat. No. 4,426,255 entitled "Disposal of PCB" issued Jan. 20, 1981, a process for the decomposition of polychlorinated biphenyls (PCB's) utilizing a molten metal salt bath is disclosed. There the PCB and a source of oxygen are fed into a reactor containing the molten salt mixture at a temperature of about 850° C. The PCB is decomposed by pyrolysis and oxidation. While the dwell times for this process are in the order of 0.2 to 0.8 seconds, the molten metal salt is depleted during the decomposition of the PCB and has to be replaced. In addition the depletion of the molten metal salt creates additional solid waste products requiring disposal.

A process for destroying PCB's in electrical insulating fluid is published in POWER, Vol. 126, No. 8, August 1982, pp. 134–135. There the process, called PCBX uses a commercially available reagent which strips chlorine atoms from the PCB nucleus and generates harmless compounds and residues. The chemical reactions are carried out under carefully controlled conditions of reagent amounts, temperature, and process time, followed by selective filtration, dehydration, and degassing. Insulating oils can be removed, processed, and returned to the equipment. However, this process is suitable for use only with fluids containing PCB's and not with solids having PCB contamination.

The use of a process suitable for fluids and solids having PCB's and which generates negligible solid wastes while having dwell times of 0.2 seconds or less to allow for a greater throughput would be desirous. In addition an apparatus for the decomposition of hazardous material which would be less costly to install and maintain and more compact than conventional incinerators would also be advantageous.

SUMMARY OF THE INVENTION

In general terms, the present invention comprises a process and apparatus for the essentially complete decomposition of hazardous materials utilizing an electric arc heater. A gas stream, preferably air, is introduced into the arcing chamber of an electric arc heater. The gas is superheated therein by the electric arc to a selected temperature in the range of about 2,000° F. to about 10,000° F. The superheated gas stream is then exhausted from the electric arc heater via an outlet nozzle. The hazardous material, preferably in liquid or gaseous form, is injected into the superheated gas stream. This mixture is then directed into a primary reactor in which the high temperature causes the rapid decomposition of the hazardous material. Typical dwell times in the primary reactor to accomplish essentially complete decomposition of the hazardous material are in the range of 0.05 to 0.15 seconds. Non-hazardous decomposition by-products, both gaseous and particulate in form, are exhausted from the primary reactor. These by-products are cooled and cleaned in a gas scrubber with the gas by-products being released to atmosphere and the particulate by-products collected for ultimate disposal.

Where disposal of hazardous materials in the form of a solid is desired, an alternate embodiment of the invention may be used. The solid material is first shredded by means of a shredder with the shredded material then being fed into a roaster such as a rotary kiln. The roaster may be heated by conventional means such as a gas or oil burner or by an electric arc heater. The heat of the roaster vaporizes the hazardous material which is then injected into the superheated gas stream for decomposition in the primary reactor. The solid material remaining in the roaster is discharged for collection for ultimate disposal. In addition, the finely-divided solids may be directly injected into the superheated gas stream exiting the arc heater.

Preneutralization of the products of decomposition may also be accomplished with the present process and apparatus. Because of the high temperatures, co-injection of a caustic solution along with the hazardous material into the superheated gas stream as it enters the primary reactor is possible without decreasing the temperature of the reactions occurring in the primary reactor. The caustic solutions are used to neutralize the decomposition by-products prior to their being cleaned and cooled.

A further modification of the apparatus and process includes the use of a soaking reactor. Where, depending upon the hazardous material undergoing decomposition, thermally stable compounds are produced in the primary reactor, longer dwell times are necessary in order to effect their complete decomposition. Therefore, a soaking reactor is positioned downstream of the primary reactor to provide additional dwell time to permit the essentially complete decomposition of the thermally stable compounds. When these thermally stable compounds are not present, the soaking reactor may be bypassed. For example, when a PCB is to undergo decomposition, the soaking reactor is usually not required.

BRIEF DESCRIPTION OF THE DRAWINGS

For a better understanding of the invention, reference may be made to the preferred embodiments exemplary of the invention shown in the accompanying drawings wherein.

DETAILED DESCRIPTION OF THE PREFERRED EMBODIMENTS

Figure 1:
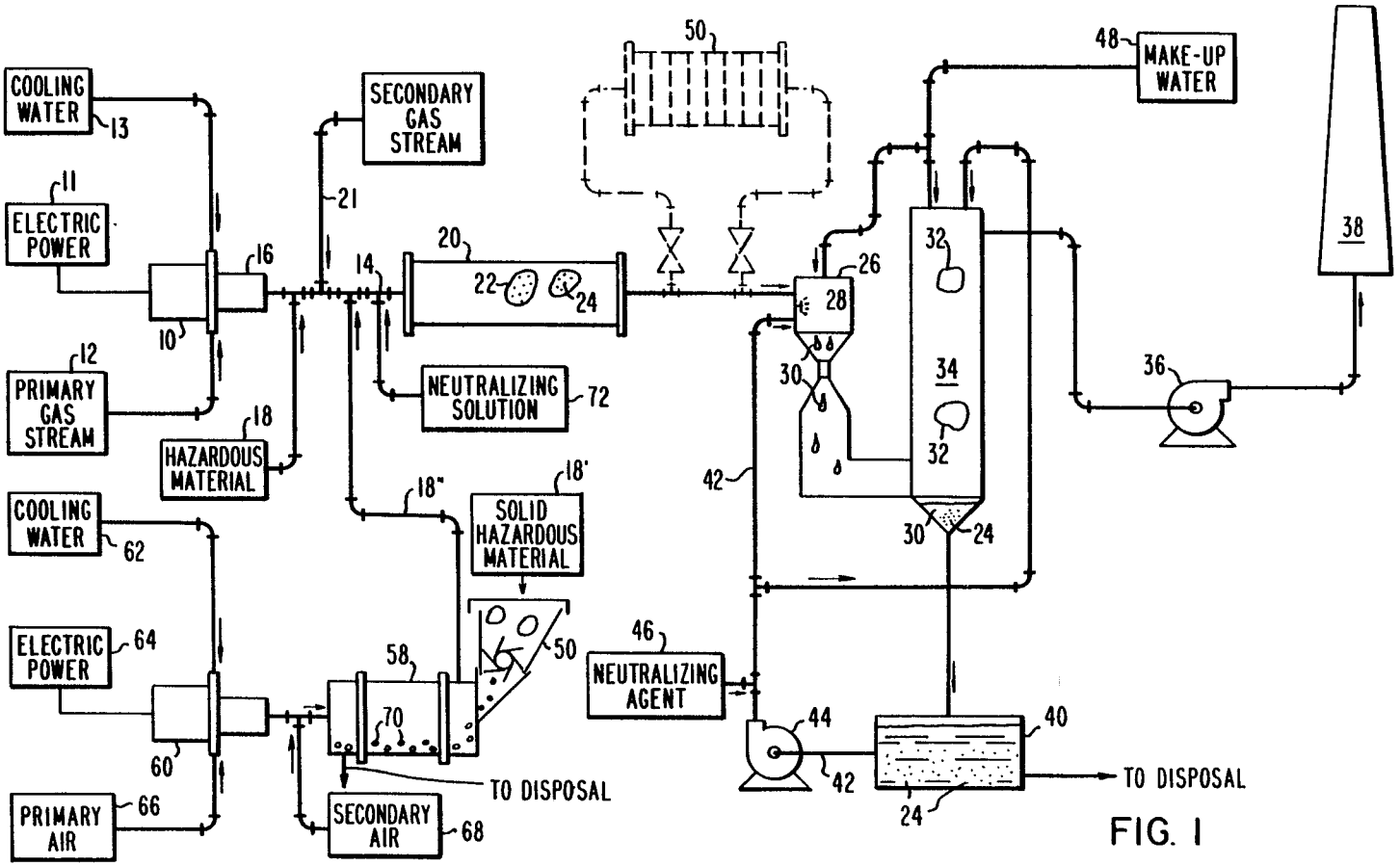
FIG. 1 is a schematic representation of the process embodying the present invention.

In accordance with the present invention, hazardous materials including PCB's are rapidly decomposed by injecting them into a superheated gas stream exiting an electric arc heater. Referring now to FIG. 1, an electric arc heater 10 is provided with electric power 11, either AC or DC, and a source of cooling water 13. An electric arc is generated in the arc chamber of the electric arc heater 10 with the primary gas stream 12, typically air or oxygen, being introduced therein and heated by the energy released from the electric arc. This primary gas can be steam, air, oxygen, nitrogen, argon or a combination of these gases; however, because of economic considerations air is normally used. The temperature of the primary gas stream 12 entering the electric arc heater is typically ambient and can be increased to a temperature in excess of 10,000° F. by the electric arc heater. However, the primary gas stream 12 is normally heated to a temperature in the range of about 2,000° F. to about 10,000° F.

As the superheated gas 14 exits the electric arc heater via an outlet nozzle 16, the hazardous material 18 is injected into the gas stream. Because of the high temperature and turbulent mixing of the superheated gas stream and the hazardous material, the hazardous material is decomposed, disassociated or otherwise destroyed to form decomposition products including $CO_2$, $O_2$, $H_2O$ or $N_2$, depending upon the gas being used. The hazardous material 18 may be injected into the arcing chamber of the electric arc heater 10; however, the decomposition products may either build-up on or erode the interior surfaces of the electric arc heater 10. Therefore, it is preferable that the hazardous material 18 be injected into the superheated gas stream 14 as it exits the outlet nozzle 16 of the electric arc heater 10. This material is then directed into a primary reactor 20 for the completion of decomposition. At this point a secondary gas stream 21 can be introduced into the superheated gas stream 14 to aid in the turbulent mixing of and the reaction between the superheated gas stream 14 and the hazardous material 18. This secondary gas stream 21 can also be introduced into the electric arc heater 10 for heating.

The electric power required by the electric arc heater and the total flow of the primary and secondary gas streams are dependent on the material undergoing decomposition and the desired temperature for decomposition; the higher the decomposition temperature, the more rapid the decomposition of the hazardous material. The total flow rate of the primary and secondary gas streams is set to be approximately equal to the stoichiometric value for the flow rate of the hazardous material. The arc heater heats the primary gas stream to a temperature such that when mixed with the hazardous material the desired temperature range for decomposition is achieved. The primary gas stream flow rate is set consistent with the total power required to reach the desired decomposition temperature range and the enthalpy capabilities (typically 4–6 $KWH/NM^3$) of the electric arc heater. Once the desired decomposition temperature for a given material is chosen, the energy to be supplied by the arc-heated primary gas stream can be calculated. Based on the heating capabilities of the electric arc heater, the primary gas stream flow rate is then set. The flow rate of the secondary gas stream is the difference between the stoichiometric flow rate and the primary gas stream flow rate. Because the enthalpy capability of the electric arc heater is adjustable, a range of primary gas stream flow rates, secondary gas stream flow rates, and electric power requirements are possible for a given material and decomposition temperature.

In the primary reactor 20 the hazardous material 18 is rapidly decomposed due to the high temperatures and the turbulent mixing. The dwell time in the primary reactor 20, i.e., the time required for the essentially complete decomposition of the hazardous material, is in the range of 0.05 to 0.15 seconds. Because of these extremely short dwell times, the physical size of the primary reactor 20 may be reduced in comparison to conventional reactors. Typically, the primary reactor 20 is refractory lined in order to withstand the high temperatures involved.

The decomposition by-products, both gaseous 22 and particulate 24 in form, are directed into a cooling chamber 26. Here the particulate by-products 24 are cleansed from the gaseous by-products 22 by means of fluid sprays 28. The particulate by-products 24 become entrained in the sprayed fluid 30 which also serves to cool the gaseous by-products 22. The cleaned and cooled by-product gases 32 along with the sprayed fluid 30 having the entrained particulate by-products 24 are then directed into a separator 34 in which the cleaned and cooled by-product gases 32 are separated from the sprayed fluid 30. These cooled by-product gases 32, which typically have a temperature in the range of about 150° F. to 200° F., are then exhausted to the atmosphere by conventional means such as a fan 36 which creates a differential pressure across the apparatus to draw the gases therethrough. The gases 32 are exhausted from the fan 36 into the stack 38 for venting into the atmosphere. These gases 32, depending on their composition, can also be combusted.

The sprayed fluid 30 collected in the separator 34 is directed into a filter 40 wherein the particulate by-products 24 are removed from the sprayed fluid 30. The particulate by-products 24 are discharged from the filter and collected for ultimate disposal. If desired, the cleaned spray fluid 42 can now be recirculated back to the fluid sprays 28 in the cooling chamber 26 by use of a pump 44. In addition, a neutralizing agent 46 such as lime may be added to the spray fluid 44 being recirculated. Because some of the sprayed fluid 30 is lost to the atmosphere due to evaporation or carry-over, make-up water 48 can be provided on the cooling chamber 26 and/or the separator 34 to ensure that the supply of spray fluid remains sufficient to cool the decomposition by-products.

With the present invention the decomposition of some hazardous materials such as toluene, anthracene, benzene and other hydrocarbons create thermally stable compounds in the primary reactor 20. In order that these thermally stable compounds are also destroyed, a soaking reactor 50 (shown in dashed lines) may be provided in the process to receive the decomposition by-products and the thermally stable compounds as they are exhausted from the primary reactor 20 and before they are directed into the cooling chamber 26. The purpose of the soaking reactor 50 is to increase the dwell time in order to permit the essentially complete decomposition of the thermally stable compound into additional decomposition by-products. These by-products are then directed into the cooling chamber 26. Where thermally stable compounds are not present, the soaking reactor can be bypassed by conventional means such as dampers 52 and 53 so that the decomposition products exiting the primary reactor 20 will go directly into the cooling chamber 26.

Preferably, the hazardous material 18 being injected into the superheated gas stream 14 is in the form of a liquid or a gas. However, a finely-divided solid may also be used. Where the hazardous material is in a larger solid form such as a PCB-filled capacitor or spill soil, the solid hazardous material 18' can be fed through a shredder 56 and then into a heated rotary kiln 58 in which the hazardous material 18'' will be vaporized and exhausted into the superheated gas stream 14 entering the primary reactor 20. For clarity a separate line is shown in FIG. 1 for the injection of the vaporized hazardous material 18'' into the superheated gas stream 14. This material 18'' can also be injected in the same manner as the hazardous material 18. Here the primary reactor 20 acts as an afterburner to the rotary kiln 58. The rotary kiln 58 can be conventionally heated by fuel oil or gas burners or can be heated by an electric arc heater 60 as shown. Again, the electric arc heater 60 is supplied with a source of cooling water 62, electric power 64, primary air 66 and secondary air 68 which can be the same sources as those used for arc heater 10. The solid material or ash 70 is discharged from the rotary kiln 58 and collected for ultimate disposal.

As shown in FIG. 1, a neutralizing solution 72 such as lime slurry or other alkaline solution can be injected into the superheated gas stream 14 for the neutralization of decomposition by-products of hazardous materials that contain halogens or other materials that will react with alkaline solutions. The reaction with the lime slurry solution will form materials such as calcium chloride that can be removed from the superheated gas stream 14 in the cooling chamber 26 or which will condense on the walls of the primary reactor 20. The high temperatures found in the superheated gas stream 14 and primary reactor 20 allow the co-injection of the caustic solution 64 into the gas 14 stream without the loss of operating temperature, thus preneutralizing the decomposition by-products vice post neutralizing them.

Figure 2:
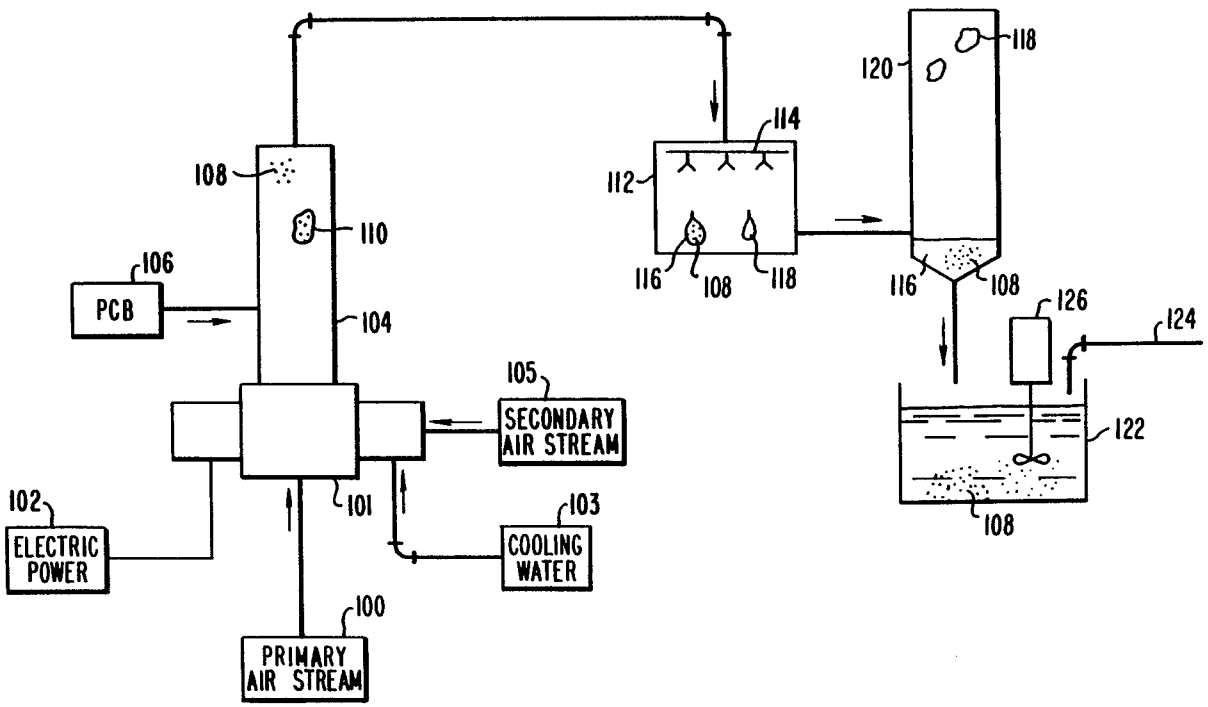
FIG. 2 is a schematic representation of a process embodying the present invention which is used for the decomposition of PCB's.

In FIG. 2, a process for the decomposition of PCB's utilizing an electric arc heater is illustrated. A primary air stream 100 at ambient temperature and a mass flow rate in the range of about 100 lb/hr to about 3,000 lb/hr, is introduced into the arcing chamber of an electric arc heater 101 that is connected to a source of electric power 102 and cooling water 103. The primary air stream 100 is superheated by means of an electric arc to a temperature in the range of about 2,000° F. to about 10,000° F. After heating, the superheated primary air is exhausted from the electric arc heater 101 via an outlet nozzle into the primary reactor 104. A secondary air stream 105 can be provided to the arc heater 101. When this secondary air stream 105 is used it has a flow rate in the range of about 50 lb/hr to about 1,500 lb/hr.

The electric power required by the electric arc heater 101 and the total flow of the primary and secondary air streams are dependent on the PCB's undergoing decomposition and the desired temperature for decomposition; the higher the decomposition temperature, the more rapid the decomposition of the PCB's. The total flow rate of the primary and secondary air streams is set to be approximately equal to the stoichiometric value for the flow rate of the PCB's. The arc heater heats the primary air stream to a temperature such that when mixed with the hazardous material the desired temperature range for decomposition is achieved. The primary air stream flow rate is set consistent with the total power required to reach the desired decomposition temperature range and the enthalpy capabilities (typically 4–6 $KWH/NM^3$) of the electric arc heater. The complex hydrocarbon rings of the PCB's are broken apart by the excess energy provided by in the form of heat by the arc-heated primary air stream releasing the hydrogen and carbon for combustion in the reactor 104. Once the desired decomposition temperature is chosen, the energy to be supplied by the arc-heated primary gas stream can be calculated. Based on the heating capabilities of the electric arc heater, the primary air stream flow rate is then set. The flow rate of the secondary air stream is the difference between the stoichiometric flow rate and the primary air stream flow rate plus any required or desired excess air. Because the enthalpy capability of the electric arc heater is adjustable, a range of primary air stream flow rates, secondary air stream flow rates and electric power requirements are possible for a given PCB or mixture of PCB's and decomposition temperature. Tables 1 and 2 provide the operating parameters at two decomposition temperatures for the PCB decomposition process of FIG. 2. For these two tables the material used with the process was hexachlorobenzene. This material was chosen in that it has the same thermal decomposition curve as PCB's; thus allowing direct applicability of this data to PCB decomposition.

TABLE 1

| | |
|---|---|
| Decomposition Temperature | 4600° F. |
| Arc Heater Power | 330 KW |
| PCB Flow Rate | 100 Lb/Hr |
| Primary Air Flow Rate | 350 Lb/Hr |
| Secondary Air Flow Rate | 290 Lb/Hr |
| Primary Air Inlet Temperature | 70° F. |
| Primary Air Outlet Temperature | 4600° F. |
| Total Air Exit Temperature | 3320° F. |

TABLE 2

| | |
|---|---|
| Decomposition Temperature | 4800° F. |
| Arc Heater Power | 580 KW |
| PCB Flow Rate | 75 Lb/Hr |
| Primary Air Flow Rate | 500 Lb/Hr |
| Secondary Air Flow Rate | 300 Lb/Hr |
| Primary Air Inlet Temperature | 70° F. |
| Primary Air Outlet Temperature | 4800° F. |
| Total Air Exit Temperature | 3200° F. |

The PCB's 106 are introduced at a flow rate in the range of about 50 lb/hr to about 2,000 lb/hr into the superheated air for reaction therewith in the primary reactor 104. This reaction and the heat of the superheated air increase the temperature within the primary reactor to a range of about 4,000° F. to 6,000° F. and decomposes the PCB's into non-hazardous particulate by-products 108 and gaseous by-products 110. These particulate and gaseous by-products are exhausted from the primary reactor 104 and into a gas scrubber 112 such as a Venturi scrubber. Here the exhausted particulate by-products 108 and gaseous by-products 110 are cooled by means of water sprays 114, having a flow rate in the range of about 5 gpm to about 100 gpm, the water sprays 114 cooling the exhausted particulate by-products 108 and gaseous by-products 110 with the particulate by-products 108 becoming entrained in the sprayed water 116. The temperature of the by-products in the gas scrubber is reduced to a range of about 150° F. to about 200° F. The sprayed water 116 containing the entrained particulate by-products 108 and the cooled and cleaned gaseous by-products 118 are then directed into a demister 120 for separation of the sprayed water 116 from the cleaned gaseous by-products 118. The cleaned gaseous by-products 118 are exhausted from the demister 120 to atmosphere.

The sprayed water 116 with the entrained particulate by-products 108 that is collected in the demister 120 is drained into a neutralization tank 122. An alkaline material 124, preferably lime, is added to the neutralization tank 122 at a rate having a range of about 50 lb/hr to about 1000 lb/hr and, is mixed by an agitator 126 with the sprayed water 116. This neutralizes the decomposition by-products entrained in the sprayed water 116. Where lime is used, the neutralized products include calcium chloride, water, solid carbon and calcium hydroxide.

The term "polychlorinated biphenyl" is defined as a chemical substance containing a biphenyl molecule that has been chlorinated to varying degrees. The polychlorinated biphenyl can be a single chemical compound, a mixture of different types of PCB's and can also include other organic substances containing less than 50 ppm PCB. Included in this definition are hexachlorobenzene, hexafluorobenzene, pentachlorobiphenyls and brominated biphenyls. Because of the high temperatures involved with the process, any non-biodegradable halogenated hydrocarbon may be utilized.

The electric arc heaters are single phase self-stabilizing devices which can be operated on DC or AC and are capable of power levels to about 3000 kilowatts or up to 10000 kilowatts for three phase AC installation. Because the electric arc heaters are of similar construction and operation to the electric arc heater disclosed in U.S. Pat. No. 3,663,792, entitled "Apparatus and Method of Increasing Arc Voltage and Gas Enthalpy in a Self Stabilizing Arc Heater", issued May 16, 1972, this patent being assigned to the assignee of the present invention, and due to the full disclosure therein the following description of the arc heaters is limited to the basic structure and operation.

Figure 3:
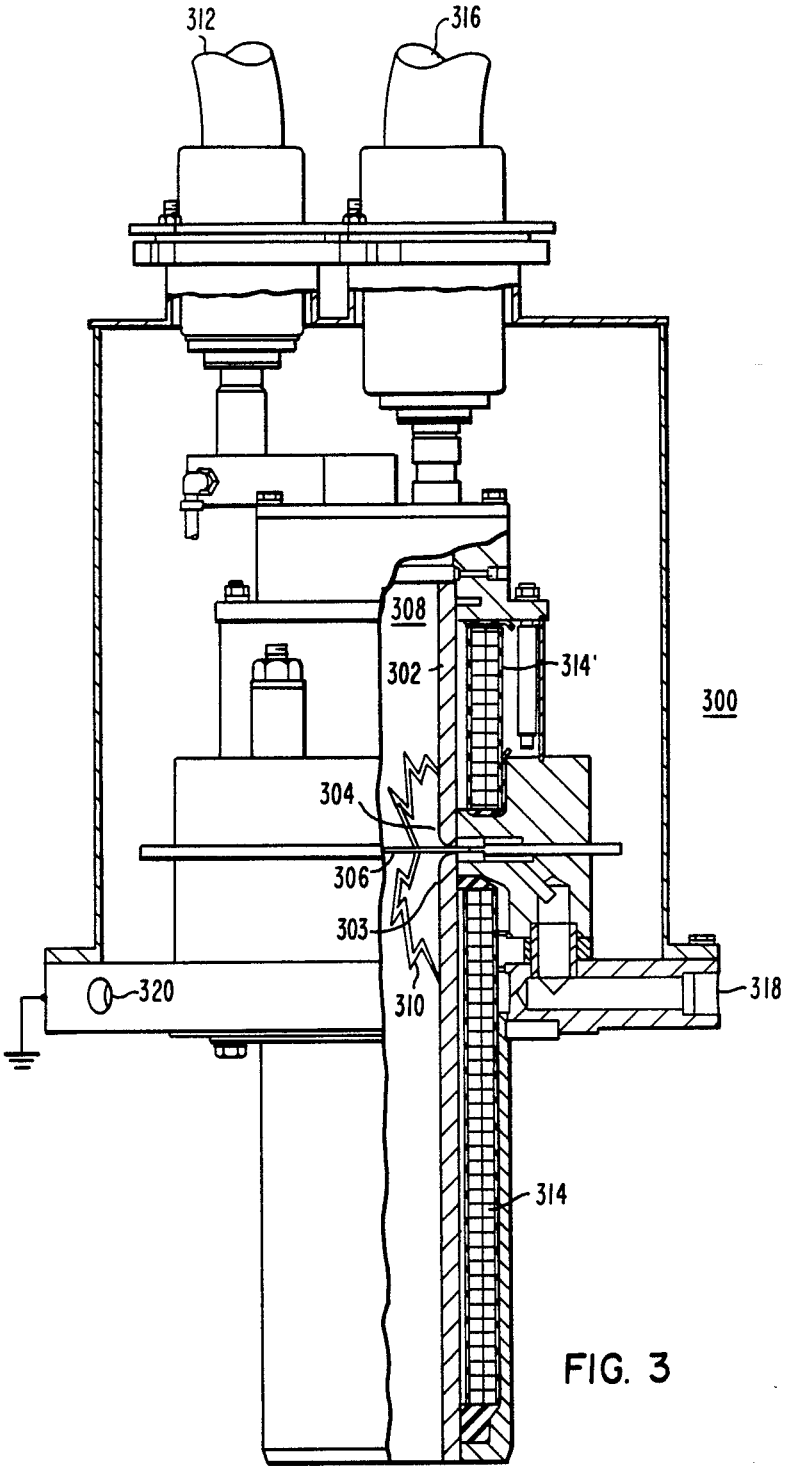
FIG. 3 is a partial cross sectional view of an electric arc heater for use in an apparatus which embodies the present invention.
Figure 4:
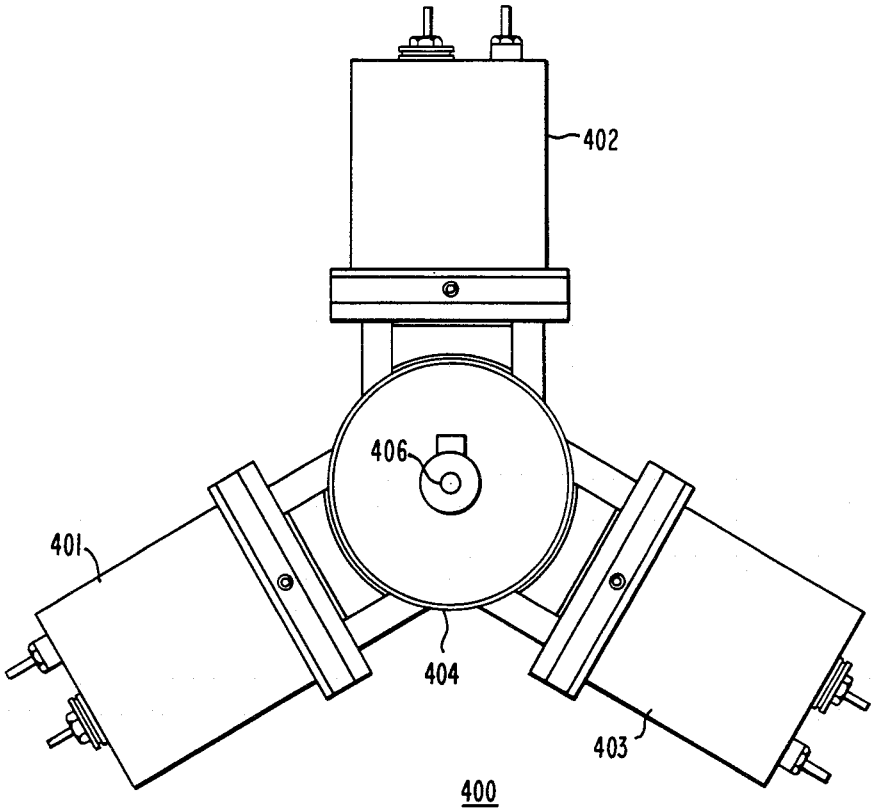
FIG. 4 illustrates an arc heater and plenum assembly which may be used in the present invention.

Various configurations for the electric arc heater which is used in the apparatus and process of the present invention are illustrated in FIGS. 3 and 4. The arc heater 300 shown in FIG. 3 can be operated on single phase AC, AC rectified DC or three phase thyristor supplied DC. The electric arc heater system 400 illustrated in FIG. 4 uses three electric arc heaters that can be operated individually on rectified or thyristor controlled DC power. The electric arc heater 300 as shown in FIG. 3 has two cylindrical electrodes, a downstream electrode 301 and an upstream electrode 302, lying along a common centerline, with the upstream end 303 of the downstream electrode 301 and the downstream end 304 of the upstream electrode 302 being axially spaced to form a small arcing gap 306. The annular interiors of the electrodes form the arcing chamber 308 wherein the electric arc 310 is formed across the gap between the downstream electrode 301 and upstream electrode 302. The downstream electrode 301 and upstream electrode 302 are electrically connected via the arc power lead 312 having two electrical conductors to an electric power supply (not shown) so that they are of opposite polarity. In addition, annular field coils 314, 314' are disposed proximate the exterior of the downstream electrode 301 and the upstream electrode 302, each coil 314, 314' being connected to the electrical power source via the field current lead 316 also having two electrical conductors. The opposite polarity for the electrode lead 312, and the field power lead 316, i.e., the return path, is through the grounded flange plate 317. The purpose of the field coils 314, 314' is to create a magnetic field which induces the rotation of the electric arc 310 about the interior surfaces of the electrodes 301, 302. A gas inlet 318 is provided for the introduction of the gas stream or primary air into the arcing chamber 308 through the electrode gap 306. An alternate gas inlet (not shown) may be provided at the upstream end of the upstream electrode 302, the inlet being located substantially along the centerline of the upstream electrode. The gas is heated by the energy released by the electric arc and exits the electric arc heater via the downstream electrode 301 which functions as the outlet nozzle. The addition of the hazardous material or the caustic solutions occurs as the heated gas exits the downstream electrode 301. A cooling fluid inlet 320 can also be provided on the electric arc heater 300 to prevent overheating. The cooling fluid which is used may be air, water or other conventional cooling fluids such as freon.

In FIG. 4 a three phase arc heater and plenum assembly 400 is illustrated. There three electric arc heaters 401, 402, 403 are symmetrically disposed about a central plenum 404, the construction of each arc heater being substantially similar to the arc heater illustrated in FIG. 3. The gas to be heated is introduced into each arc heater via their gas inlets with the superheated gas exiting the downstream electrode of each and being collected in the plenum assembly 404. A plenum gas connection 406 may also be provided on the plenum for the introduction of gas or hazardous material into the interior of the plenum assembly. The superheated gas stream and/or hazardous material exist the plenum assembly through an outlet and are then directed into the primary reactor for the completion of decomposition.

We claim:

1. A process for the essentially complete decomposition of hazardous materials comprising:

(a) introducing a primary gas stream into an arcing chamber of an electric arc heater;

(b) heating the primary gas stream by means of an electric arc in the arcing chamber to a temperature in the range of 2,000° F. to 10,000° F.;

(c) exhausting the heated primary gas stream from the electric arc heater via an outlet into a primary reactor;

(d) introducing hazardous material into the heated primary gas stream for reaction therein in the primary reactor, the decomposition products of reaction containing particulate and gaseous by-products, the particulate by-products being entrained by the gaseous by-products;

(e) exhausting the particulate and gaseous by-products from the primary reactor;

(f) cooling the exhausted by-products in a cooling chamber by means of fluid sprays, the sprayed fluid becoming entrained with the particular by-products;

(g) exhausting the cooled and cleaned gaseous by-products from the cooling chamber into the atmosphere; and (h) separating from the sprayed fluid the cooled particulate by-product entrained therein by filter means thereby cleaning the sprayed fluid and allowing for the removal of the particulate by-products.

2. The process as described in claim 1 wherein the reaction further comprises:

forming, in addition to particulate and gaseous by-products, thermally stable compounds, the formulation of these compounds being dependent on the hazardous material undergoing decomposition; and exhausting the by-products and thermally stable compounds into a soaking reactor wherein the thermally stable compounds have additional time in which to substantially decompose into additional particulate and gaseous by-products.

3. The process as described in claim 1 wherein a secondary gas stream is introduced into the electric arc heater and is heated therein, the secondary gas stream mixing with the primary gas stream and the hazardous material.

4. The process as described in claim 1 further comprising introducing a neutralizing agent into the superheated gas stream for reaction with the hazardous material and/or the by-products in the primary reactor.

5. The process as described in claim 4 wherein the neutralizing agent is an alkaline solution.

6. The process as described in claim 5 wherein the alkaline solution consists of lime and water.

7. The process as described in claim 1 wherein the introduction of hazardous material further comprises:

(a) shredding solids containing hazardous materials;

(b) directing the shredded solids into a heated roaster wherein the shredded solids are heated to a temperature sufficient to vaporize the hazardous material;

(c) exhausting the vaporized hazardous material from the roaster into the heated primary gas stream; and (d) discharging the solids remaining in the roaster for collection for ultimate disposal.

8. The process as described in claim 1 wherein the primary gas stream is selected from a group consisting of air, steam, oxygen, nitrogen, or argon.

9. A process for the essentially complete decomposition of polyhalogenated hydrocarbons, comprising:

(a) introducing primary air into an arcing chamber of an electric arc heater;

(b) heating the primary air by means of an electric arc in the arcing chamber to a temperature in the range of about 2,000° F. to about 10,000° F.;

(c) exhausting the heated primary air from the electric arc furnace via an outlet into a primary reactor;

(d) introducing the polyhalogenated hydrocarbons into the heated primary air for reaction therein in the primary reactor, the reaction increasing the temperature within the primary reactor to a range of about 4,000° F. to about 6,000° F. and forming decomposition products containing particulate and gaseous by-products from the decomposition of the polyhalogented hydrocarbons;

(e) exhausting the particulate and gaseous by-products from the primary reactor;

(f) cooling the exhausted particulate and gaseous by-products by means of water sprays in a gas scrubbing means, the water sprays cooling the exhausted particulate and gaseous by-products with the particulate by-products becoming entrained in the sprayed water, the cooled by-products having a temperature in the range of about 150° F. to about 200° F.;

(g) separating the sprayed water containing the entrained particulate by-products and the gaseous by-products in a demister;

(h) exhausting the cleaned, cooled gaseous by-products from the demister to atmosphere; and (i) mixing the sprayed water with an alkaline material thereby neutralizing the sprayed water and entrained particulate by-products.

10. The process as described in claim 9 wherein the polyhalogenated hydrocarbons are selected from the group consisting of hexafluorobenzene, brominated biphenyl or polychlorinated biphenyls.

11. The process as described in claim 9 wherein the primary air has a mass flow rate in the range of about 100 lb/hr to about 3,000 lb/hr.

12. The process as described in claim 11 wherein the polyhalogenated hydrocarbons have a flow rate in the range of about 50 lb/hr to about 2,000 lb/hr.

13. The process as described in claim 12 wherein the water sprays have a flow rate in the range of about 5 gpm to about 100 gpm.

14. The process as described in claim 13 wherein the alkaline material consists essentially of lime and has a flow rate in the range of about 50 lb/hr to about 1,000 lb/hr.

15. The process as described in claim 10 wherein the primary air has a mass flow rate in the range of about 100 lb/hr to about 3,000 lb/hr;

the polychlorinated biphenyls have a flow rate in the range of about 50 lb/hr to about 2000 lb/hr;

the water sprays have a flow rate in the range of about 5 gpm to about 100 gpm; and the alkaline material consists essentially of lime and has a flow rate in the range of about 50 lb/hr to about 1,000 lb/hr.

16. The process as described in claim 10 wherein the primary air has a flow rate in the range of about 100 lb/hr to about 3000 lb/hr and the polychlorinated biphenyls have a flow rate in the range of about 50 lb/hr to about 2000 lb/hr.

17. The process as described in claim 16 wherein secondary air is introduced into the electric arc heater being heated therein and having a flow rate in the range of about 50 lb/hr to about 1,500 lb/hr, the secondary air increasing the turbulence of the reaction between the polychlorinated biphenyls and the superheated primary air.

* * * * *